United States Patent [19]

Akita et al.

[11] 4,449,386

[45] May 22, 1984

[54] STEEL PIPE ROLLING MILL

[75] Inventors: Shinji Akita; Masayuki Hatanaka, both of Yokohama; Akira Uemura, Tokyo, all of Japan

[73] Assignee: Nippon Kokan Kabushiki Kaisha, Tokyo, Japan

[21] Appl. No.: 394,110

[22] Filed: Jul. 1, 1982

[30] Foreign Application Priority Data

Jul. 10, 1981 [JP] Japan ..... 56-106873

[51] Int. Cl.[3] ..... B21B 31/08

[52] U.S. Cl. ..... 72/100; 72/95; 72/239

[58] Field of Search ..... 72/95, 96, 97, 99, 100, 72/239, 238

[56] References Cited

U.S. PATENT DOCUMENTS 3,733,876 5/1973 Hlafcsak ..... 72/239

3,845,646 11/1974 Bellmann et al. ..... 72/100

4,387,584 6/1983 Akita et al. ..... 72/100

FOREIGN PATENT DOCUMENTS 55-40071 3/1980 Japan ..... 72/239

737039 5/1980 U.S.S.R. ..... 72/95

*Primary Examiner*—Lowell A. Larson

*Attorney, Agent, or Firm*—Michael N. Meller

[57] ABSTRACT

In an apparatus for changing the rolling mill rolls and/or disk shoes of a steel pipe rolling mill, the top and bottom rolls vertically movably mounted in the housing are individually placed on a supporting bed positioned below the bottom rolling roll and moved in and out of the mill by way of rails laid in the lower part of the housing, and each of the disk shoes is mounted on a supporting arm which is movable vertically and rotatable thereby making it possible to change the disk shoes even during the operation.

6 Claims, 6 Drawing Figures

STEEL PIPE ROLLING MILL

The present invention relates to vertical two-roll disk shoe type seamless steel pipe rolling mills and more particularly to an apparatus for changing the rolling mill rolls and/or the disk shoes which are used in such rolling mills.

This type of rolling mill (a piercer, elongator or the like) is so designed that a heated material (hereinafter referred to as a billet) is passed between rolls which are arranged vertically and inclined relative to each other and a plug mounted on the forward end of a mandrel bar is forced into the billet from the opposite side thereby producing a thick-walled hollow crude pipe. Since the rolls used in this type of rolling mill are subject to wear or damage due to their use over a long period of time, it is necessary to change the rolls with new rolls at times. The rolling mill also includes a pair of circular disk shoes which are arranged between the rolls so as to prevent the crude pipe from expanding between the rolls during the piercing of the material and the outer periphery of the disk shoes is formed into an arcuate shape corresponding to the external shape of billets thus making it necessary to change the disk shoes when the outer diameter of billets changes. Further, the outer peripheral surface of the disk shoes are always contacted with the hot billet and therefore it is necessary to change the disk shoes from time to time due to the wear and damage caused by a long period of use.

In the past, it has been the practice such that the changing operation of the rolls in such a rolling mill is effected by first lifting the cover placed on the top of a housing by an overhead crane, successively lifting the top and bottom rolls mounted in the housing and moving them to other place and conveying new rolls by the overhead crane and mounting them in the rolling mill, and the disk shoes are similarly changed by means of the overhead crane. However, with the rolling mills of this construction the top of the housing is opened with the result that it is difficult to ensure a high degree of mill stiffness and also the changing operation requires much time and labor with the resulting considerable decrease in the efficiency due to the shut down of the rolling mill. There are many other disadvantages in that it is impossible to use the overhead crane for any other operation during the changing of the rolls or the disk shoes and so on, thus requiring early solution of these problems.

It is therefore an object of the present invention to provide an improved steel pipe rolling mill capable of automatically and rapidly changing its rolls and/or disk shoes and easily moving the same into or out of its housing without using any overhead crane.

It is another object of the invention to provide such improved steel pipe rolling mill so designed that the cradle moved by a supporting bed into the lower part of a housing is moved to the outside along rails laid in the lower part of the housing and also a new cradle moved into the housing along the rails is placed on the supporting bed which in turn raises and mounts the cradle in place in the housing, thereby making it possible to change the cradles without opening the top of the housing and increasing the mill stiffness.

It is still another object of the invention to provide such improved steel pipe rolling mill so designed that the supporting arm of each disk shoe is movable vertically and also rotatable such that even during the operation the disk shoes can be changed rapidly and easily and also a carriage moves the changed disk shoe to the outside of the housing and moves a new disk shoe into the housing.

It is still another object of the invention to provide such improved steel pipe rolling mill so designed that the cradles can be changed automatically in a short period of time and also the disk shoes can be changed even during the operation, thereby greatly reducing the loss time due to the changing of the cradles and/or the disk shoes with the resulting improvement of the productivity and reducing the number of persons required for the changing operation.

The present invention has been made to accomplish the above objects and the invention features that in a steel pipe rolling mill wherein two cradles each holding a rolling roll are arranged vertically and a heated material is passed between the top and bottom rolls thereby producing a hollow crude pipe, a plurality of wheels are arranged on the lower surface of each of the top and bottom cradles and a supporting bed is vertically movably arranged below the bottom cradle and provided on its upper surface with rails so arranged that when the cradle is placed on the supporting bed its wheels are engaged with the rails thereby permitting its transverse movement. There is another feature that in a steel pipe rolling mill wherein two cradles each holding a rolling roll are arranged vertically and a heated material is passed between the top and bottom rolls thereby producing a hollow crude pipe, a disk shoe supporting arm is movably vertically and rotatably fitted on each of at least one pair of main shafts attached to a housing and a carriage adapted to hold the disk shoe on its upper surface and having wheels on its lower surface is arranged so as to move transversely along rails laid to extend through the housing at right angles to the rolling path line.

In accordance with the invention there is still another feature that in a steel pipe rolling mill in which two cradles each holding a rolling roll are vertically arranged and a heated material is passed between the top and bottom rolls thereby producing a hollow crude pipe, a plurality of wheels are provided on the lower surface of each cradle, a supporting bed is vertically movably arranged below the bottom cradle and is provided on its upper surface with rails such that when the cradle is placed on the supporting bed its wheels are engaged with the rails permitting it to move transversely, a disk shoe supporting arm is movably vertically and rotatably mounted on each of at least one pair of main shafts attached to a housing, and a carriage adapted to hold the disk shoe on its upper surface and having wheels on its lower surface is arranged to move transversely along rails laid to extend through a housing at right angles to the rolling path line.

The above and other object, features and advantages of the invention will become readily apparent from the following description taken in conjunction with the accompanying drawings in which.

Figure 1:
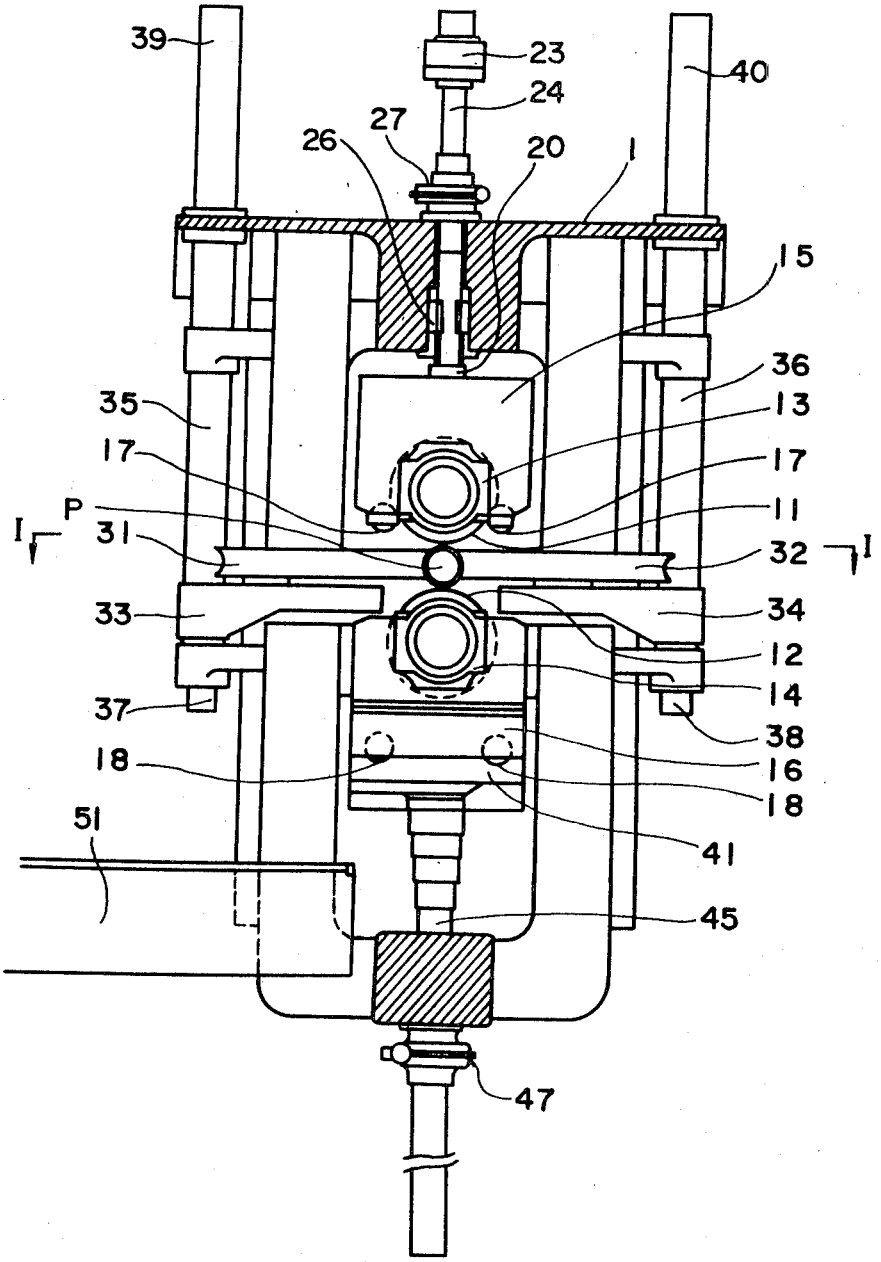
FIG. 1 is a partly sectional front view of an embodiment of the invention.
Figure 2:
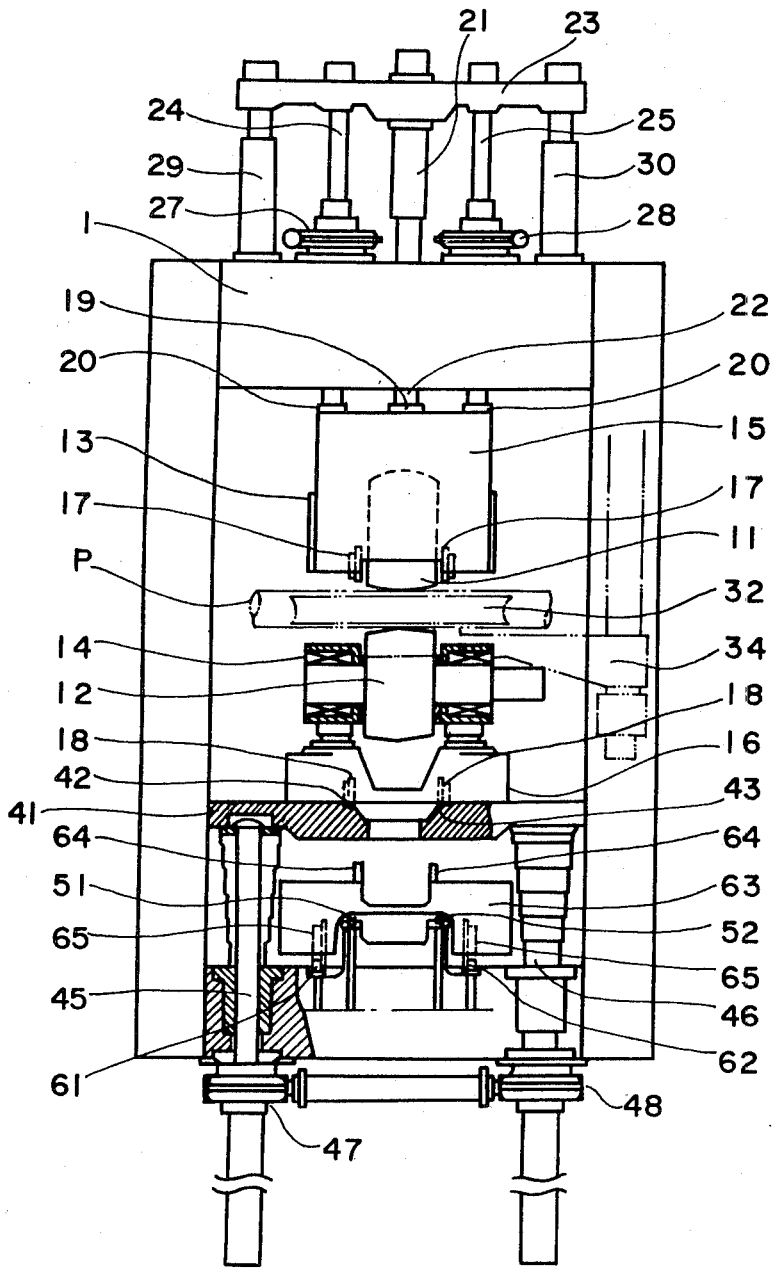
FIG. 2 is a partly sectional side view of FIG. 1.
Figure 3:
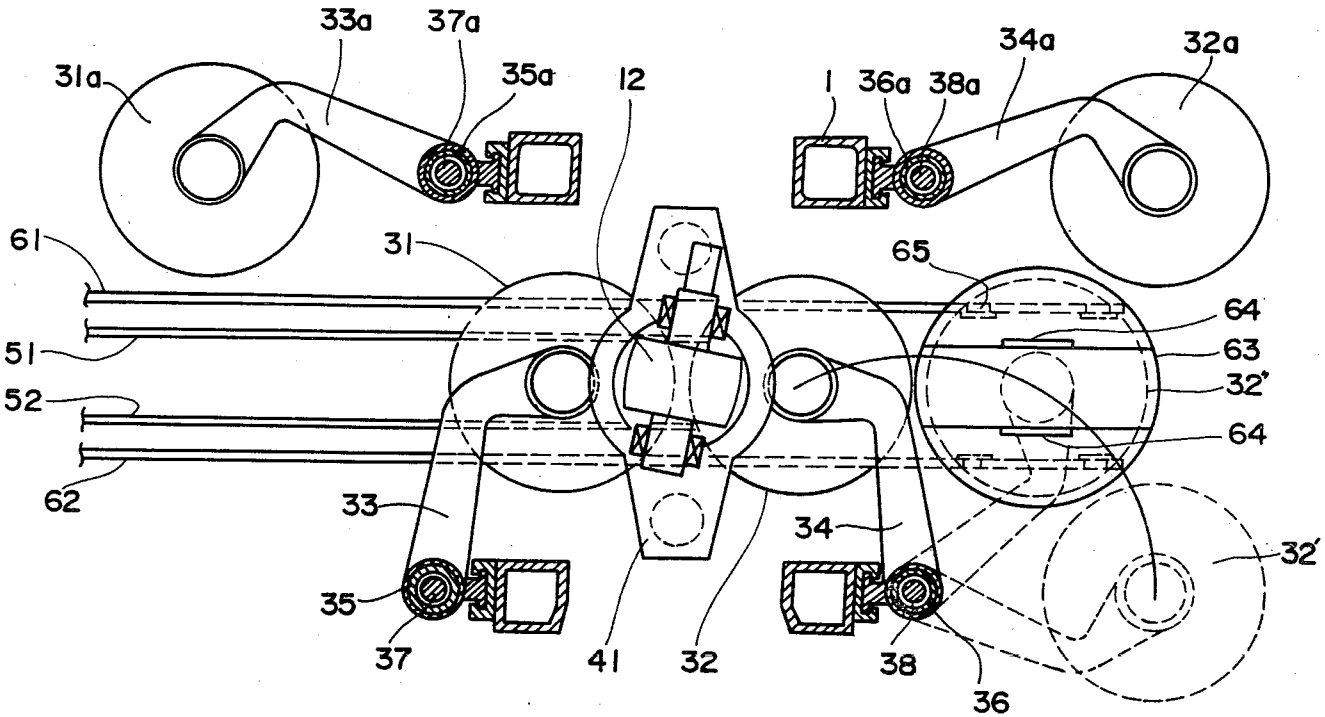
FIG. 3 is a sectional view taken along the line I—I of FIG. 1, showing the conditions in the mill during the cradle and disk shoe changing operation.

Referring to FIGS. 1 to 3, numerals 11 and 12 designate rolls which are respectively supported on cradles 15 and 16 by way of chocks 13 and 14. Numerals 17 and 18 designate wheels which are mounted on the lower surface of the cradles 15 and 16, respectively. Numeral 21 designates a balance cylinder fixed to a supporting member 23 and the forward end of its operating rod 22 is detachably coupled to a support 19 of the cradle 15. Numerals 24 and 25 designate screws which are respectively engaged with internal threads 26 formed in a housing 1 and connected to the cradle 15 at the forward end thereof. Numerals 27 and 28 designate drive mechanisms which are driven by a motor (not shown), for example, to move the screws 24 and 25 in the vertical direction. Numerals 29 and 30 designate hydraulic cylinders fixed to the housing 1 and their operating rods are coupled to the supporting member 23.

Numerals 31, 32 and 31*a* and 32*a* designate disk shoes, 33, 34 and 33*a*, 34*a* supporting arms for the disk shoes 31 to 32*a*, 35, 36 and 35*a*, 36*a* chocks attached to the housing 1 and having respectively main shafts 37, 38 and 37*a*, 38*a* fitted therethrough. The supporting arms 33 to 34*a* are respectively coupled to the main shafts 37 to 38*a*. Numerals 39, 40 and 39*a*, 40*a* (not shown) designate hydraulic cylinders whose operating rods are respectively coupled to the main shafts 37 to 38*a* to move them in the vertical direction. The supporting arms 33 to 34*a* are respectively adapted for rotation about the main shafts 37 to 38*a*. While, in these Figures, one pair each of the main shafts 37 to 38*a*, the supporting arms 33 to 34*a*, etc., is provided on each side of the housing, only one pair each of these elements may be provided on one side of the housing.

Figure 4:
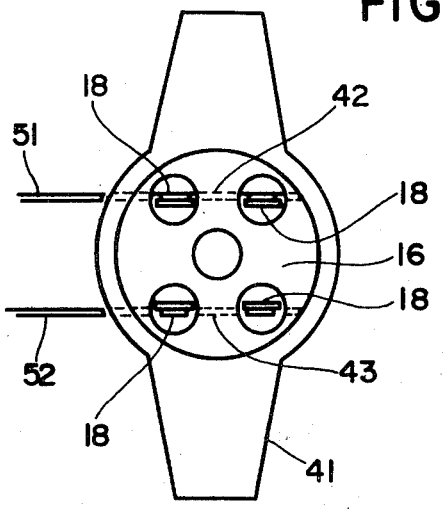
FIG. 4 is a plan view of a supporting bed.

Numeral 41 designates a supporting bed for the cradle 16 and it is supported by screws 45 and 46 which are moved vertically by drive mechanisms 47 and 48, respectively. As shown in FIG. 4, rails 42 and 43 are provided on the upper portion of the supporting bed 41 and the wheels 18 of the cradle 16 are placed on the rails 42 and 43.

Numerals 51 and 52 designate rails laid to cross the pass line of a billet P at right angles and the rails 51 and 52 are arranged in the lower part of the housing 1 at the same distance apart as the rails 42 and 43 provided on the supporting bed 41. Numerals 61 and 62 designate rails which are respectively laid on the outer sides of and below the rails 51 and 52, and 63 a carriage. As shown in FIG. 3, two projections 64 are formed on the upper surface of the carriage 63 and also mounted on its lower surface are wheels 65 which are placed on the rails 61 and 62.

Figure 5:
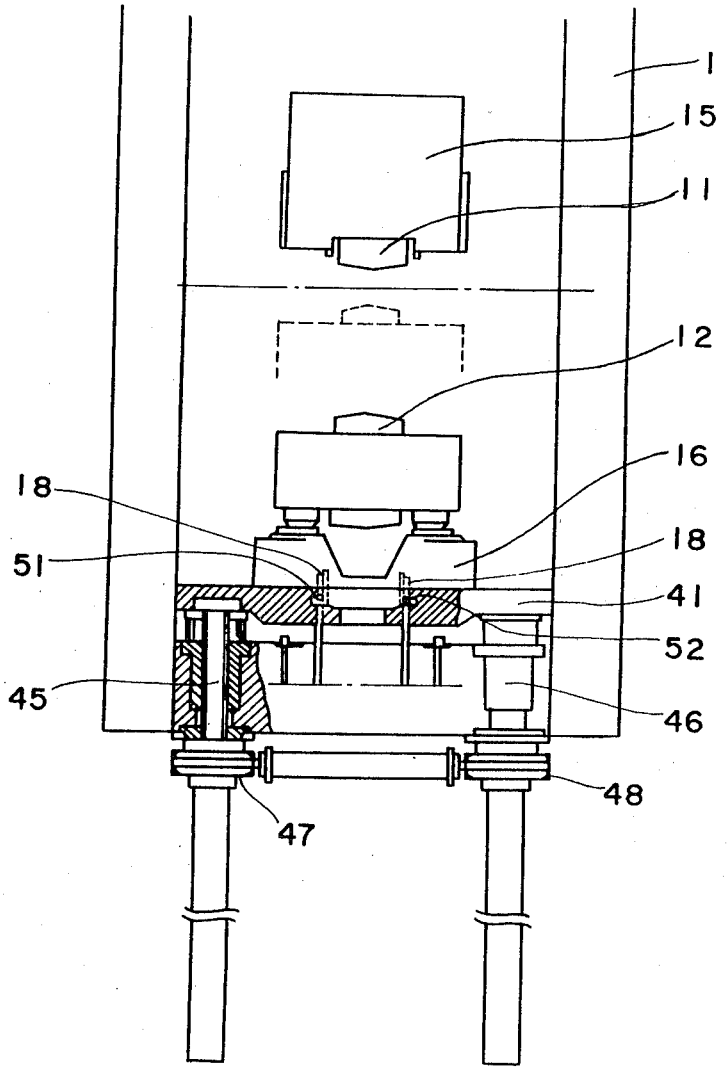
FIG. 5 is a partly omitted and partly sectional side view, showing the conditions in the mill during the cradle changing operation.

With the embodiment of the invention constructed as described above, the operation of changing the top and bottom rolls will now be described. The drive mechanisms 47 and 48 are operated first so that the screws 45 and 46 are moved downward and the supporting bed 41 is lowered to stop at a position where the rails 42 and 43 of the supporting bed 41 are aligned with the rails 51 and 52 (See FIG. 4). This condition is shown in FIG. 5. Then, the cradle 16 is pulled out so that the cradle 16 is transferred from the rails 42 and 43 of the supporting bed 41 onto the rails 51 and 52 thereby allowing the delivery of the cradle 16 to the outside along the rails 51 and 52.

To change the top rolling roll, the supporting bed 41 is raised again by the screws 45 and 46 and it is moved into substantially the initial position. Then, the cradle 15 is lowered by the balance cylinder 21 and the screws 24 and 25 so that the cradle 15 is placed on the supporting bed 41 and the wheels 17 are engaged with the rails 42 and 43, thereby disengaging the operating rod 23 of the balance cylinder 21 and the screws 24 and 25 with the cradle 15. In this condition, as in the case of the bottom cradle 16, the supporting bed 41 is lowered and the cradle 15 is delivered to the outside along the rails 51 and 52. The mounting of new rolls can be accomplished by performing the above-mentioned operating steps in the reverse order.

Figure 6:
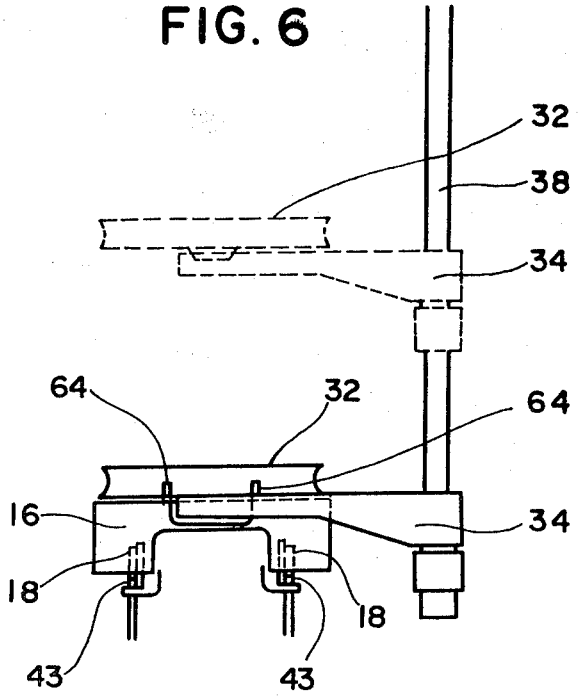
FIG. 6 is a partly omitted side view, showing the conditions in the mill during the cradle changing operation.

Next, the operation of changing the disk shoes will be described. In accordance with the present invention, the unused disk shoes 31*a* and 32*a* are mounted on the supporting arms 33*a* and 34*a* which are not in use. As shown in FIG. 3, the supporting arm 34 of the disk shoe to be changed (e.g., 32) is moved in a clockwise direction to move the disk shoe to a position 32′ and the supporting arm 34*a* of the other disk shoe 32*a* is rotated to set the unused disk shoe 32*a* in the operating position. Then, the supporting arm 34 is moved in a counterclockwise direction and stopped at a position (32″) where the center of the disk shoe 32 is brought substantially to the central position between the rails 61 and 62. It is assumed that in this condition the carriage 63 is located below the disk shoe 32. Then, as shown in FIG. 6, the supporting arm 34 is lowered so that the disk shoe 32 is engaged with the projections 64 of the carriage 63 and the supporting arm 34 is lowered slightly and then rotated again outwardly, thereby leaving the disk shoe 32 on the carriage 63. In this condition, the carriage 63 is pulled out of the lower part of the housing 1 along the rails 61 and 62 thereby bringing the disk shoe 32 to the outside. The other disk shoe 31 can be moved to the outside in the same way.

An unused disk shoe can be mounted on each of the supporting arms 33 to 34*a* by performing the reverse operation, and after the unused disk shoe has been mounted the supporting arm is rotated outwardly and held in a stand-by position so that when the disk shoe in use is to be changed, the supporting arm is rotated and set in the operating position.

While the construction and operation of an embodiment of the invention have been described hereinabove, the present invention is not intended to be limited thereto and it should be apparent that the objects of the invention can be accomplished by any other arrangement having the similar functions.

What is claimed is:

1. In a steel pipe rolling mill in which two cradles each holding a rolling mill roll are arranged one above the other and a heated material is passed between the top and bottom rolls thereby producing a hollow crude pipe, the improvement wherein a plurality of wheels are mounted on the lower surface of each of said top and bottom cradles, and wherein a supporting bed is vertically movably positioned below said bottom cradle and a track is provided on the upper surface of said supporting bed whereby when one of said cradles is placed on said supporting bed the wheels of said one cradle are engaged with said track thereby allowing transverse movement of said one cradle.

2. In a steel pipe rolling mill in which two cradles each holding a rolling mill roll are arranged one above the other and a heated material is passed between said top and bottom rolls thereby producing a hollow crude pipe, the improvement wherein a supporting arm for a disk shoe is mounted movably vertically and rotatably on each of at least one pair of main shafts attached to a housing, and wherein a carriage is provided which is adapted to hold one of said disk shoes on the upper surface thereof and having a plurality of wheels on the lower surface thereof so as to move transversely on a track laid to extend through said housing and cross a rolling pass line at right angles.

3. In a steel pipe rolling mill in which two cradles each holding a rolling mill roll are arranged one above the other and a heated material is passed between said top and bottom rolls thereby producing a hollow crude pipe, the improvement wherein a plurality of wheels are mounted on the lower surface of each of said cradles, wherein a supporting bed is vertically movably positioned below said bottom cradle, said supporting bed being provided with a track on the upper surface thereof whereby when one of said cradles is placed on said supporting bed the wheels of said one cradle are engaged with said track to allow transverse movement of said one cradle, wherein a supporting arm for a disk shoe is mounted movably verticaly and rotatably on each of at least one pair of main shafts attached to a housing, and wherein a carriage is provided which is adapted to hold one of said disk shoes on the upper surface thereof and having a plurality of wheels on the lower surface thereof so as to move transversely on another track laid to extend through said housing and cross a rolling path line at right angles.

4. A steel pipe rolling mill according to claim 1 or 3, wherein said supporting bed is supported and moved vertically by screw means.

5. A steel pipe rolling mill according to claim 1 or 3, wherein still another track is provided to cross a rolling pass line at right angle in the lower part of a housing whereby when said supporting bed is lowered said track provided thereon is aligned with said still another track.

6. A steel pipe rolling mill according to claim 2 or 3, wherein each of said disk shoe supporting arms is moved vertically by hydraulic means.

* * * * *